US007896790B1

(12) United States Patent
Wei

(10) Patent No.: US 7,896,790 B1
(45) Date of Patent: Mar. 1, 2011

(54) INVERSION TABLE

(75) Inventor: Tsao-Kuang Wei, Daya Township, Taichung County (TW)

(73) Assignee: Paradigm Inc., Taichung County (TW)

( * ) Notice: Subject to any disclaimer, the term of this patent is extended or adjusted under 35 U.S.C. 154(b) by 0 days.

(21) Appl. No.: 12/725,500

(22) Filed: Mar. 17, 2010

(51) Int. Cl.
*A63B 26/00* (2006.01)

(52) U.S. Cl. ..... 482/144; 482/145

(58) Field of Classification Search ..... 482/142–145, 482/34–40, 139, 148; 601/1, 5, 32; 158/845
See application file for complete search history.

(56) References Cited

U.S. PATENT DOCUMENTS

| | | | | |
|---|---|---|---|---|
| 5,967,956 | A * | 10/1999 | Teeter | 482/144 |
| 6,814,691 | B1 * | 11/2004 | Kuo | 482/145 |
| 7,052,448 | B2 * | 5/2006 | Teeter | 482/144 |
| 7,063,652 | B1 * | 6/2006 | Teeter et al. | 482/145 |
| 7,118,518 | B1 * | 10/2006 | Teeter | 482/144 |
| 7,125,372 | B1 * | 10/2006 | Teeter et al. | 482/144 |
| 7,361,128 | B2 * | 4/2008 | Chen | 482/144 |
| 7,500,939 | B2 * | 3/2009 | Chen | 482/144 |
| 7,507,192 | B2 * | 3/2009 | Teeter et al. | 482/144 |
| 7,544,157 | B2 * | 6/2009 | Teeter et al. | 482/144 |
| 7,585,264 | B1 * | 9/2009 | Wang et al. | 482/144 |
| 7,625,326 | B2 * | 12/2009 | Teeter et al. | 482/144 |
| 7,625,327 | B1 * | 12/2009 | Teeter et al. | 482/144 |
| 2003/0153442 | A1 * | 8/2003 | Kuo | 482/144 |
| 2006/0046915 | A1 * | 3/2006 | Huang | 482/145 |
| 2009/0054216 | A1 * | 2/2009 | Teeter | 482/144 |
| 2009/0054217 | A1 * | 2/2009 | Teeter | 482/144 |

* cited by examiner

*Primary Examiner* — Lori Baker
(74) *Attorney, Agent, or Firm* — Alan Kamrath; Kamrath & Associates PA

(57) ABSTRACT

An inversion table has a mounting bracket, a backrest, an ankle clamp assembly and a holding device. The mounting bracket has a rear supporting frame and two front supporting legs. The backrest is connected pivotally to the rear supporting frame. The ankle clamp assembly is securely connected to the backrest to clamp a person's ankles. The holding device is mounted on the rear supporting frame of the mounting bracket at a position opposite to the ankle clamp assembly and has two holding bars. Each holding bar has two self-casings connected to each other around the rear supporting frame and each self-casing has a mounting segment and a holding segment. The mounting segment is mounted on the rear supporting frame and has a mounting recess and multiple supporting ribs. The holding segment is formed on the free ends of the mounting segment to provide a holding and gripping effect.

6 Claims, 5 Drawing Sheets

INVERSION TABLE

BACKGROUND OF THE INVENTION

1. Field of the Invention

The present invention relates to an inversion table and, more particularly, to an inversion table that can be operated easily.

2. Description of Related Art

Conventional exercising machines include exercising bikes, treadmills and surfing machines. The conventional exercising machines have mechanical structures and linkage shafts to simulate exercise dynamics to exercise at least one muscle group for training, rehabilitation or the like. To use a conventional inversion table, a person lies on a backrest thereof to relax or relieve back pain. The conventional inversion backrest has a mounting bracket, a backrest and an ankle clamp assembly. The backrest is pivotally attached to the mounting bracket. The ankle clamp assembly is connected to the backrest to clamp and hold a person's ankles when the backrest is pivoted to an inverted position.

When a person uses the conventional inversion table to invert, the backrest only can be rotated at a specified inverted angle, and the person needs to touch the ground using the person's hands to hold the backrest perpendicular to the ground and to obtain an optimum inversion effect. This is inconvenient. Furthermore, when the person wants to rotate the backrest to return upright, the person has to hold the side bars of the mounting bracket to obtain an upward reverse force to rotate the backrest, but this is difficult and laborious to make the backrest rotate upright.

The invention provides an inversion table that mitigates or obviates the aforementioned problems.

SUMMARY OF THE INVENTION

The main objective of the present invention is to provide an inversion table that can be operated easily.

The inversion table in accordance with the present invention has a mounting bracket, a backrest, an ankle clamp assembly and a holding device. The mounting bracket has a rear supporting frame and two front supporting legs to form a triangular form. The backrest is connected pivotally to the rear supporting frame. The ankle clamp assembly is securely connected to the backrest to clamp and hold a person's ankles. The holding device is mounted on the rear supporting frame of the mounting bracket at a position opposite to the ankle clamp assembly and has two holding bars. Each holding bar has two self-casings connected to each other around the rear supporting frame, and each self-casing has a mounting segment and a holding segment. The mounting segment is mounted on the rear supporting frame and has a mounting recess and multiple supporting ribs. The holding segment is formed on the free ends of the mounting segment to provide a holding and gripping effect.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
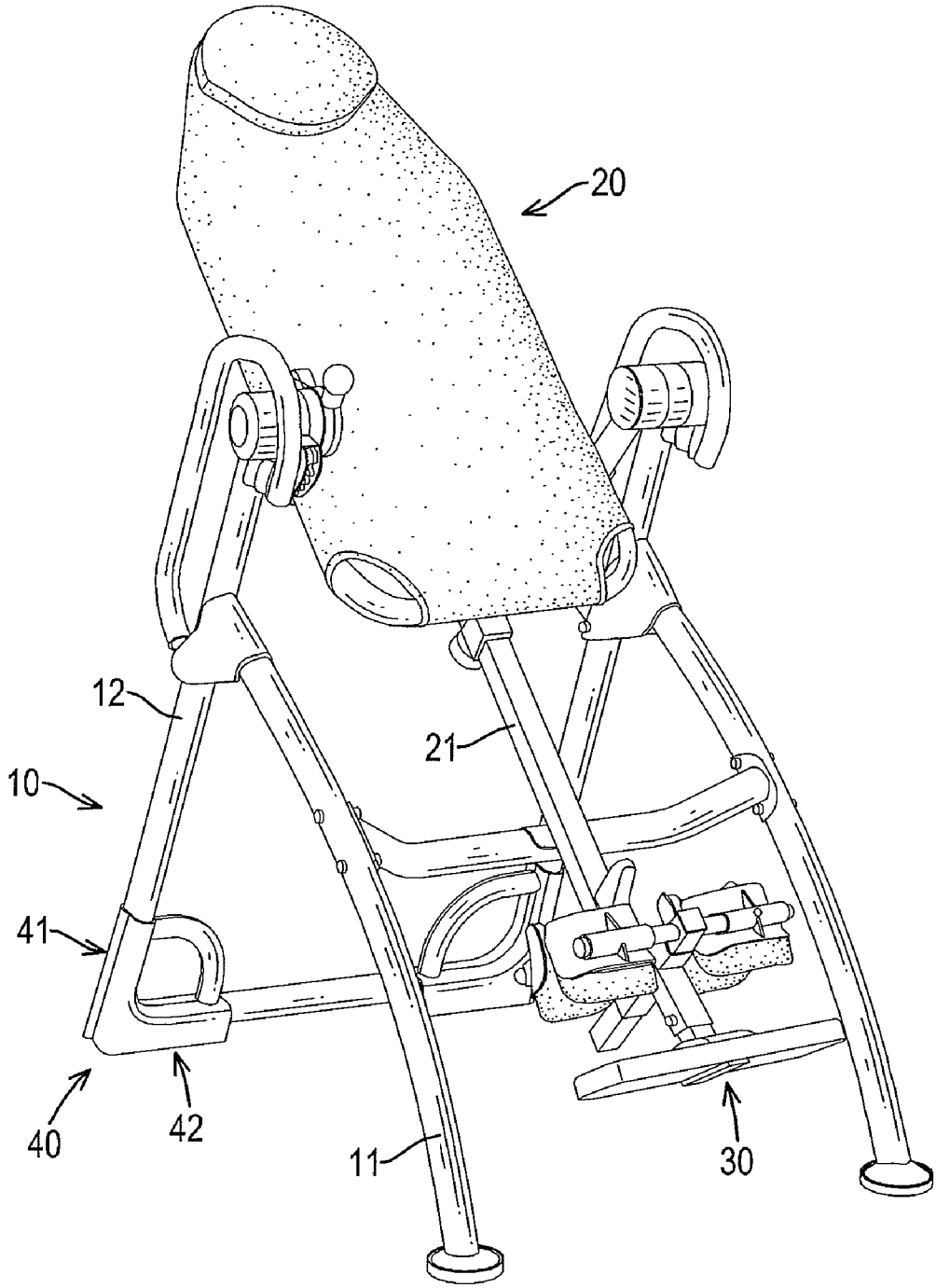
FIG. 1 is a perspective view of an inversion table in accordance with the present invention.

With reference to FIG. 1, an inversion table in accordance with the present invention has a mounting bracket (10), a backrest (20), an ankle clamp assembly (30) and a holding device (40).

The mounting bracket (10) has a rear supporting frame (12) and two front supporting legs (11) to form a triangle. The rear supporting frame (12) is U-shaped and has a bottom side, two free ends and two pivotal elements. Preferably, with reference to FIG. 3, the cross section of the bottom side of the rear supporting frame (12) is elliptical. The pivotal elements are separately mounted on the free end of rear supporting frame (12) and face each other. The front supporting legs (11) are respectively and securely attached to the rear supporting frame (12) near the free ends.

The backrest (20) is connected pivotally to the pivotal elements of the rear supporting frame (12) of the mounting bracket (10) and has a bottom end and a connecting arm (21). The connecting arm (21) is adjustably connected to the bottom end of the backrest (20) and has a connecting end.

The ankle clamp assembly (30) is securely connected to the connecting end of the connecting arm (21) of the backrest (20) to clamp and hold a person's ankles.

Figure 2:
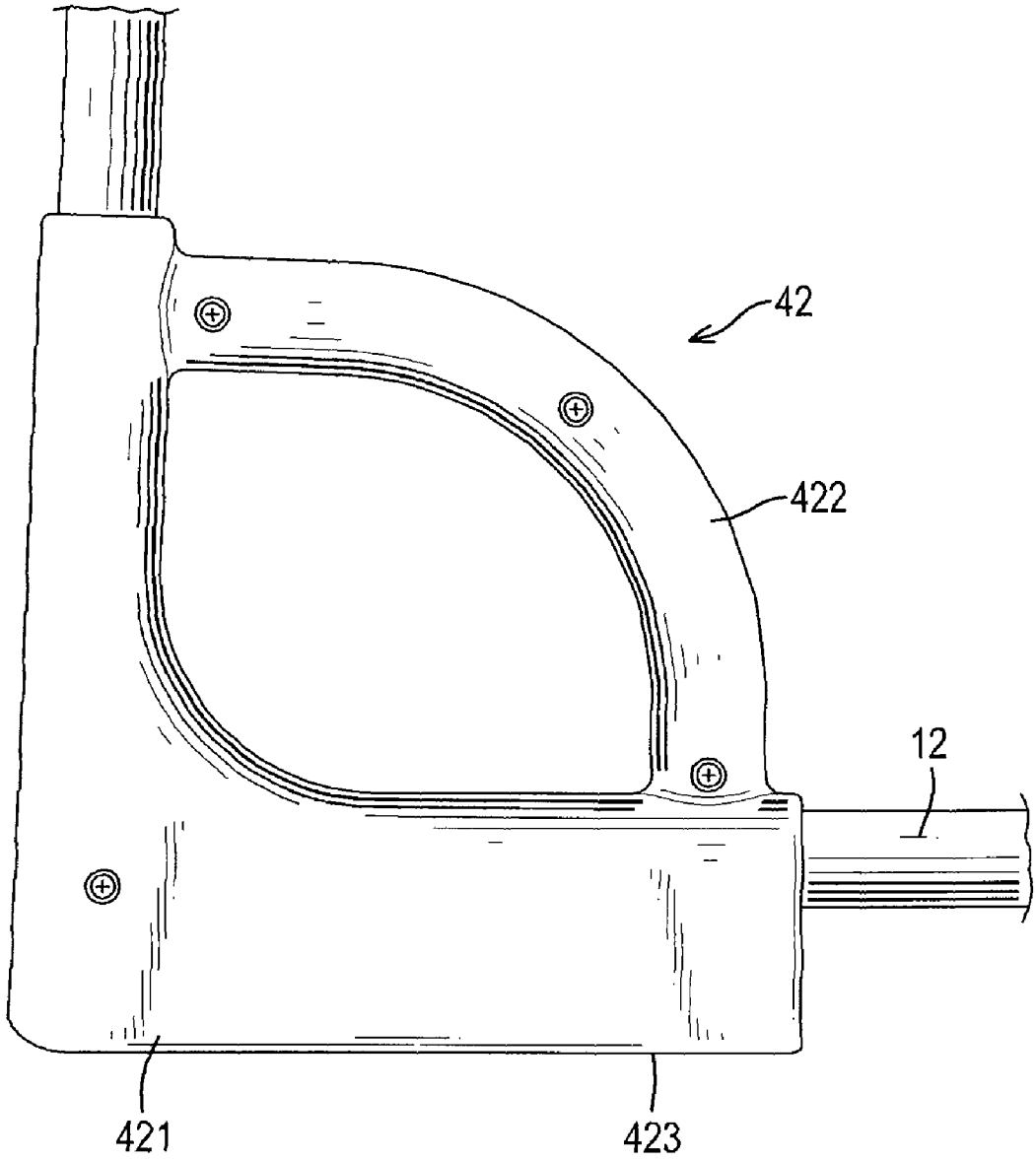
FIG. 2 is an enlarged side view of a holding device of the inversion table in FIG. 1.
Figure 3:
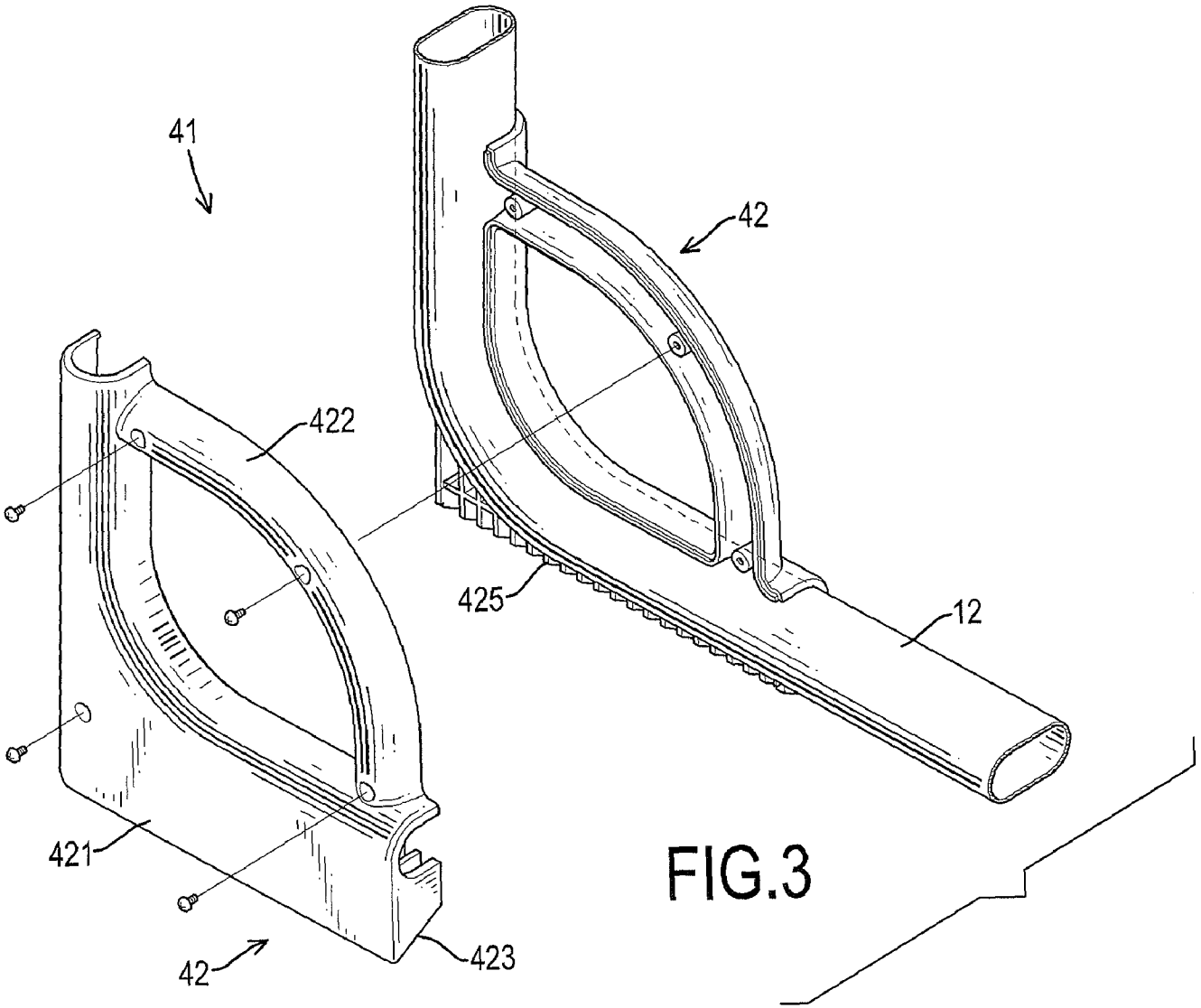
FIG. 3 is an enlarged exploded perspective view of the holding device in FIG. 2.
Figure 4:
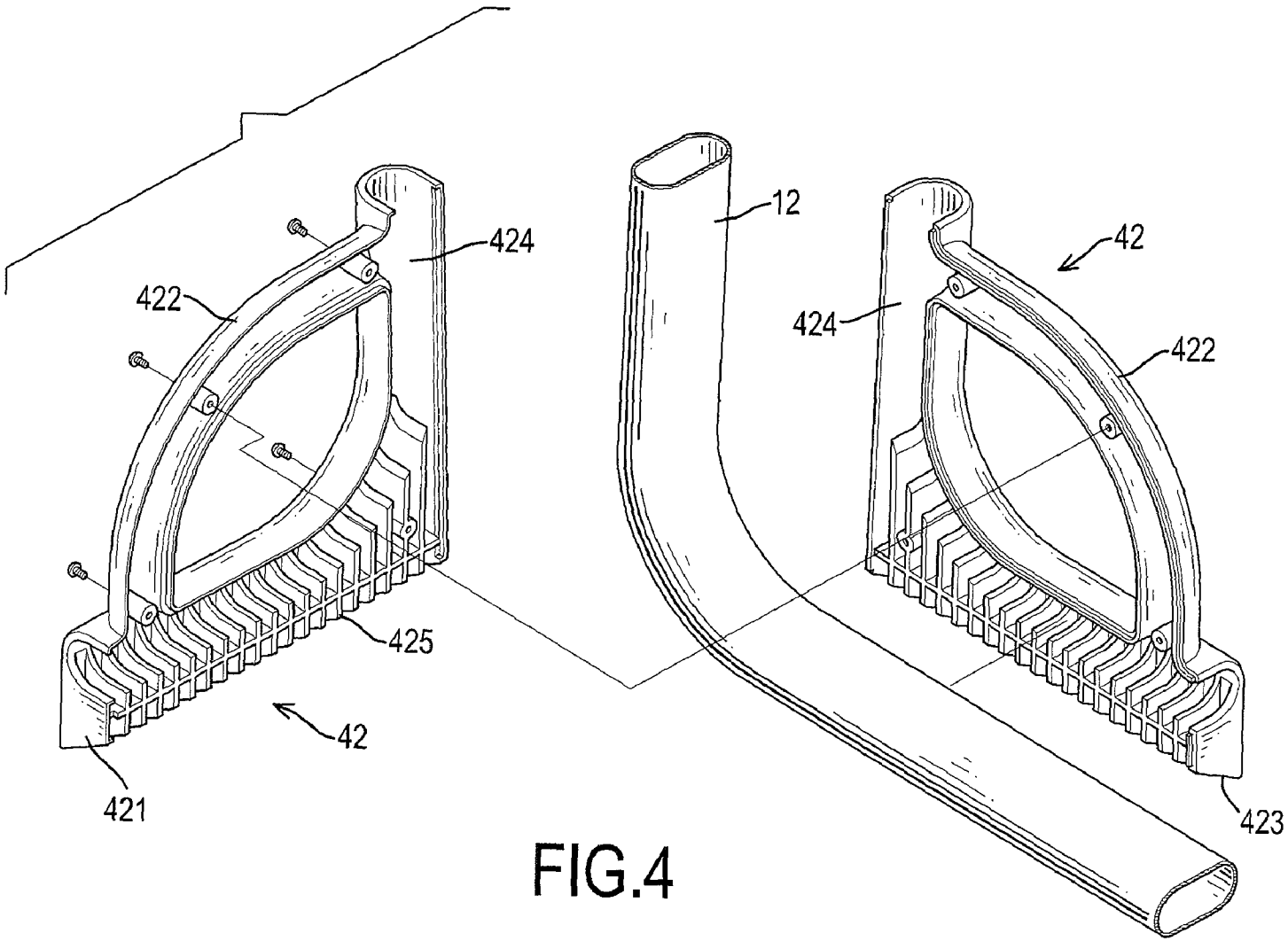
FIG. 4 is another enlarged exploded perspective view of the holding device in FIG. 2.

With reference to FIGS. 2 to 4, the holding device (40) is mounted on the rear supporting frame (12) of the mounting bracket (10) at a position opposite to the ankle clamp assembly (30) and has two holding bars (41). The holding bars (41) are symmetrically mounted on the bottom side of the rear supporting frame (12) of the mounting bracket (10) and abut the ground. Each holding bar (41) has two self-casings (42).

The self-casings (42) are connected to each other around the bottom side of the rear supporting frame (12) by fasteners, and each self-casing (42) has a mounting segment (421) and a holding segment (422). The mounting segment (421) may be L-shaped, is mounted on the rear supporting frame (12) and has two free ends, a bottom side, an inner side, an abutting face (423), a mounting recess (424) and multiple supporting ribs (425). The abutting face (423) is formed on the bottom side of the mounting segment (421) and abuts the ground. The mounting recess (424) is formed in the inner side of the mounting segment (421) between the free ends and is mounted on the rear supporting frame (12) near the bottom side. The supporting ribs (425) are formed in and protrude from the mounting recess (424) at intervals near the abutting face (423) to enhance structural strength of the mounting segment (421). The holding segment (422) is bent and is formed on the free ends of the mounting segment (421) opposite to the abutting face (423) of the mounting segment (421) to provide a holding and gripping effect.

Figure 5:
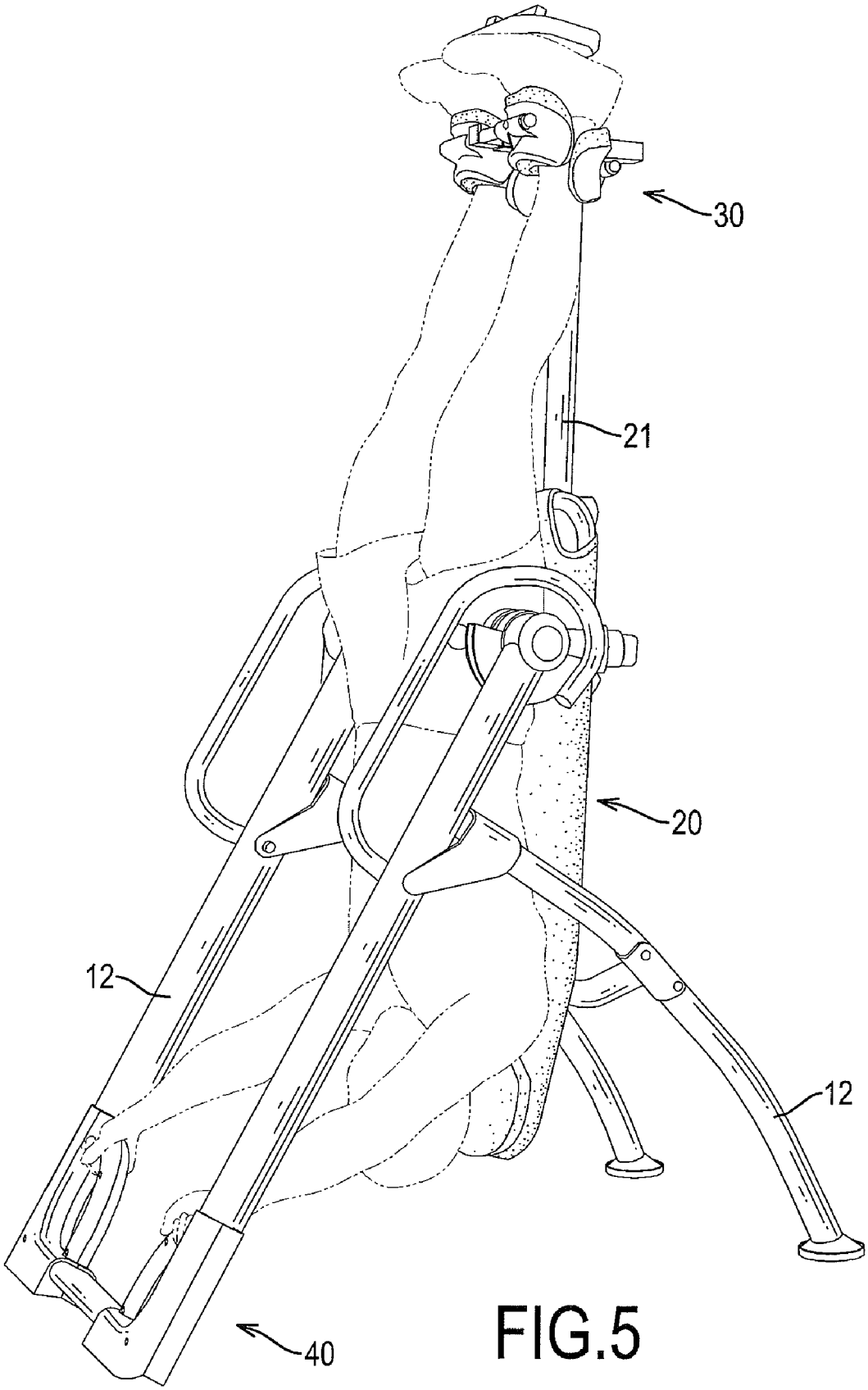
FIG. 5 is an operational perspective view of the inversion table in FIG. 1.

With reference to FIG. 5, when a person uses the inversion table to invert, the person can push the holding segments (422) of the holding bars (41) using their hands to make the backrest (20) perpendicular to the ground easily without touching the ground. Accordingly, an optimum inversion effect is provided. When the user wants to recover to an upright position, the user can pull the holding segments (421) of the holding bar (41) to obtain an upward reverse force to rotate the backrest (20) to the original position easily without pushing the ground so the inversion table is convenient to use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An inversion table having a mounting bracket having a rear supporting frame being U-shaped and having a bottom side;

two free ends; and two pivotal elements separately mounted on the free end of rear supporting frame; and two front supporting legs respectively and securely attached to the rear supporting frame near the free ends to form a triangular mounting bracket;

a backrest connected pivotally to the pivotal elements of the rear supporting frame of the mounting bracket and having a bottom end; and a connecting arm adjustably connected to the bottom end of the backrest and having a connecting end;

an ankle clamp assembly securely connected to the connecting end of the connecting arm of the backrest to clamp and hold a person's ankles; and a holding device mounted on the rear supporting frame of the mounting bracket at a position opposite to the ankle clamp assembly and having two holding bars symmetrically mounted on the bottom side of the rear supporting frame of the mounting bracket, and each holding bar having two self-casings connected to each other around the bottom side of the rear supporting frame and each self-casing having a mounting segment mounted on the rear supporting frame and having two free ends;

a bottom side;

an inner side;

a mounting recess formed in the inner side of the mounting segment between the free ends and mounted on the rear supporting frame near the bottom side;

multiple supporting ribs formed in and protruding from the mounting recess at intervals near the abutting face to enhance the structure strength of the mounting segment; and a holding segment bent and formed on the two free ends of each of the mounting segments of the two self-casings to provide a holding and gripping effect.

2. The inversion table as claimed in claim 1, wherein each mounting segment has an abutting face formed on the bottom side of the mounting segment.

3. The inversion table as claimed in claim 2, wherein each mounting segment is L-shaped.

4. The inversion table as claimed in claim 3, wherein the cross section of the bottom side of the rear supporting frame is elliptical.

5. The inversion table as claimed in claim 1, wherein each mounting segment is L-shaped.

6. The inversion table as claimed in claim 1, wherein the cross section of the bottom side of the rear supporting frame is elliptical.

* * * * *